United States Patent [19]

Hucul et al.

[11] Patent Number: 4,872,613

[45] Date of Patent: Oct. 10, 1989

[54] MASTIC ADHESIVE FIXTURE

[76] Inventors: Daniel E. Hucul, c/o Auto/Con Corp., 35380 Union Lk Rd., Mt. Clemens, Mich. 48043; Ronald R. Matheson, 53340 Beechwood Dr., Utica, Mich. 48087

[21] Appl. No.: 51,279

[22] Filed: May 18, 1987

[51] Int. Cl.[4] ..... B05B 15/06; F01B 15/06

[52] U.S. Cl. ..... 239/280; 239/95; 239/273; 92/134; 222/334

[58] Field of Search ..... 417/401, 402, 375, 399; 92/134; 239/124, 93, 95, 273, 280, 285; 222/334

[56] References Cited

U.S. PATENT DOCUMENTS

| | | | |
|---|---|---|---|
| 278,019 | 5/1883 | Huffer | 417/399 |
| 3,385,522 | 5/1968 | Kock | 239/124 |
| 3,891,126 | 6/1975 | Segawa | 92/134 |
| 3,908,373 | 9/1975 | Peterson | 92/134 |
| 3,987,708 | 10/1976 | Uhrich | 92/134 |
| 4,022,269 | 5/1977 | Segawa | 222/334 |
| 4,462,759 | 7/1984 | McGeehee | 417/399 |
| 4,516,473 | 5/1985 | Oneyama et al. | 92/134 |
| 4,516,700 | 5/1985 | Guzowski | 222/334 |
| 4,759,260 | 7/1988 | Lew | 92/134 |

OTHER PUBLICATIONS

"Lincoln Model 84540 Material Ejector"-Bulletin 426, Lincoln, St. Louis.

*Primary Examiner*—Andres Kashnikow
*Assistant Examiner*—Christopher G. Trainor
*Attorney, Agent, or Firm*—Harness, Dickey & Pierce

[57] ABSTRACT

An assembly for applying a fluid on a workpiece from a fluid storage supply includes a fluid supply for supplying a fluid. An air supply supplies compressed air. An injector is connected to the fluid supply for receiving fluid from the fluid supply and for receiving air from the air supply and injecting the fluid to the workpiece in response to the air being supplied thereto. A solenoid interconnects the air supply and the injector for controlling the air supply to the injector to actuate the injector. An accumulator receives exhausted air from the injector in response to the actuation of the injector and returns air from the accumulator after the actuation of the injector is completed to allow the injector to be actuated again.

11 Claims, 4 Drawing Sheets

MASTIC ADHESIVE FIXTURE

TECHNICAL FIELD

The subject invention relates to an assembly for pneumatically applying a fluid on a workpiece from a fluid storage supply.

BACKGROUND ART

An applicator having an injector cylinder is typically used to receive compressed air to inject a fluid such as a glue to a workpiece. In a conventional double acting method, compressed air from a main air supply is used to move the cylinder piston through an ejection header to inject the fluid to the workpiece. A reset header is connected to the other side of the cylinder piston. The reset header uses compressed air from the main air supply to move the piston cylinder back to its original position, and the cycle is repeated.

Such devices require a large amount of compressed air from a main air supply both to actuate the cylinder piston and to return the piston to its original position. Also, the response time for injector actuation is slowed by the time needed for the actuation of the reset header, resulting in lower production rates. Further, the device generates a large amount of noise.

STATEMENT OF THE INVENTION AND ADVANTAGES

An assembly for applying a fluid on a workpiece from a fluid storage supply includes a fluid supply means for supplying a fluid from a fluid supply. An air supply means supplies compressed air from an air supply source. An injector means is connected to the fluid supply means for receiving fluid from the fluid supply means and for receiving air from the air supply means and injecting the fluid to the workpiece in response to the air being supplied thereto. A control means interconnects the air supply means and the injector means for controlling the air supply to the injector means to actuate the injector means. An accumulator means receives exhausted air from the injector means in response to the actuation of the injector means and returns air from the accumulator means after the actuation of the injector means is completed to allow the injector means to be actuated again.

Accordingly, the subject invention eliminates the need to use compressed air from the main air supply to return the cylinder piston to its original position. The subject invention may also utilize a nitrogen bladder as a "decompression chamber" to pressurize the fluid supply, resulting in faster response time for injector actuation and allowing increased production rates. Thus, efficiency is increased. Also, less noise is generated by using the accumulator.

Other advantages of the present invention will be readily appreciated as the same becomes better understood by reference to the following detailed description when considered in connection with the accompanying drawings.

FIGURES IN THE DRAWINGS

DETAILED DESCRIPTION OF THE DRAWINGS

Figure 1:
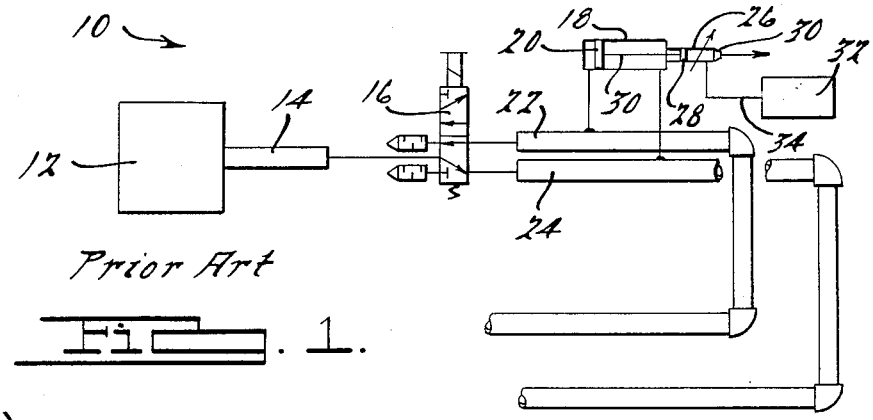
Prior Art FIG. 1.
FIG. 1 is a schematic view of a prior art control.

As illustrated in FIG. 1, a conventional or prior art control for injecting a fluid such as glue to a workpiece (not shown) is generally shown at 10. The control device 10 includes a main air supply 12 connected via a conduit 14 to a solenoid operated air valve 16. An injection cylinder 18 includes a first piston 20 disposed therein for reciprocating movement. An injection air header 22 comprising a conduit is interconnected between the solenoid 16 and the injection cylinder 18 on one side of the first piston 20. A reset air header 24 comprising a conduit is interconnected between the solenoid 16 and the injection cylinder 18 on the other side of the first piston 20. A second fluid cylinder 26 is connected to one end of the injection cylinder 18. The second fluid cylinder 26 includes a second piston 28 disposed therein for reciprocating movement. The second piston 28 is connected to the first piston 20 via a connecting rod 30.

A second fluid supply 32 is connected via a conduit 34 to one end of the fluid cylinder 26. The second piston 28 only interacts with fluid from the second fluid supply 32 on one side of the second piston 28 as the piston 28 travels through the second cylinder 26. The second cylinder 26 also includes an adjustable stop 36 to vary the flow volume through the second cylinder 26.

In operation, compressed air from the main air supply 12 passes via conduit 14 through the solenoid 16 and the injection nair header 22 to advance the first piston 20 in the direction of the arrow and inject fluid in the second cylinder 26. The solenoid 16 is then set in its second position and exhausts the air from the injection air header 22 to the atmosphere. Compressed air then passes via conduit 14 through the solenoid 16 in its first position and the reset header 24 to reset or retract the first piston 20 back to its original position in order to repeat the cycle. Typically, a control 10 having 25 feet of 1¼ inch header pipe 22 and a cylinder 18 having a 6 inch bore and a 1 inch stroke to apply a 1 inch bead of viscous fluid from the fluid supply 32 to a workpiece requires 20.33 H.P. for actuation through one cycle of operation. A suitable injector including both cylinders 18, 26 is a Lincoln Model 84540 material injector.

Figure 2:
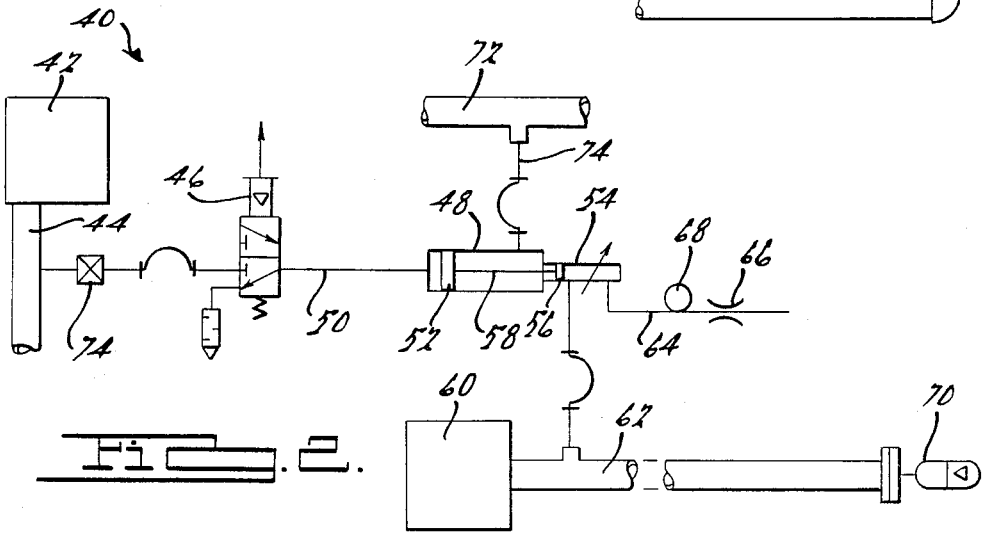
FIG. 2 is a schematic view of a control of the subject invention.
Figure 3:
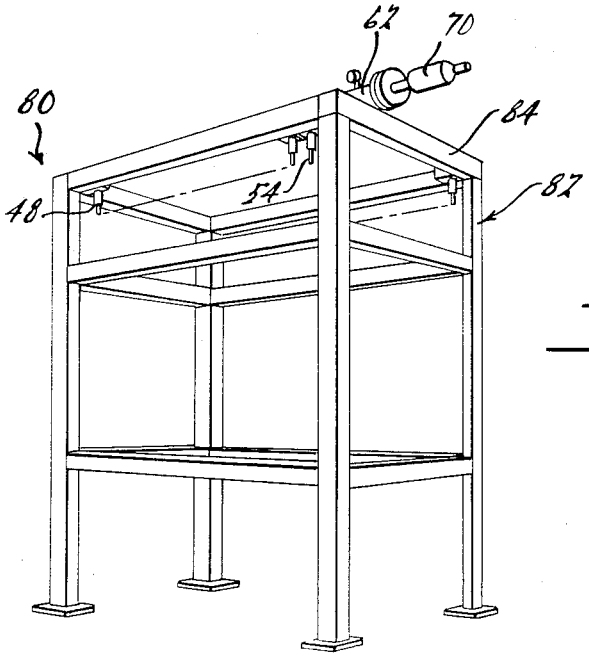
FIG. 3 is a perspective view of an assembly including a plurality of injectors mounted upon a support structure.

Turning now to the subject invention, a control device for applying a viscous fluid on a workpiece is generally shown at 40 in FIG. 2. The control device 40 includes a main air supply 42. The main air supply 42 supplies compressed air via a first conduit 44 to a solenoid operated air valve 46. An injection cylinder 48 is connected to the solenoid 46 via an air injection air header 50 comprising a conduit. The injection cylinder 48 includes a first piston 52 slideably disposed therein for reciprocating movement. The air injection header 50 is connected to the injection cylinder 48 on one side of the first piston 52. A second fluid cylinder 54 is connected to one end of the injection cylinder 48. The second fluid cylinder 54 includes a fluid or second piston 56 slideably disposed therein for reciprocating movement. The second piston 56 is connected to the first piston 52 via a connecting rod 58.

A second fluid supply 60 is connected via a second conduit 62 to one end of the second fluid cylinder 54. The second piston 56 only interacts with fluid from the second fluid supply 60 on one side of the second piston 56 as the second piston 56 travels through the second fluid cylinder 54. A fluid conduit 64 is connected to the output end of the second fluid cylinder 54. A nozzle 66 is connected to the other end of the fluid conduit 64. The fluid conduit 64 includes a loop 68 to prevent siphoning of the fluid from the second fluid cylinder 54. A nitrogen bladder accumulator 70 is attached to one end of the second fluid supply 60 to act as a "decompression chamber" thereby achieving faster response time for actuation of the second fluid cylinder 54 and increased production rates.

An accumulator reservoir 72 is connected through a reset air header 74 comprising a conduit to the injection cylinder for receiving exhausted air from the injection cylinder 48 in response to the actuation of the first piston 52. The accumulator reservoir 72 also returns the pressurized exhausted air after the actuation of the first piston 52 to return the first piston 52 to its original position as will be described below. The injection cylinder 48 may then be actuated again. The control device 40 also includes several features not noted in this description which are conventional to the disclosed structure such as a lockable ball valve 74 interconnecting the main air supply 42 and solenoid 46 for quick lockout of the entire control device 40 from the source of pressurized air.

In operation, compressed air from the main air supply 42 passes through the solenoid 46 and injection air header 50 to the injection cylinder 48 to move the piston 52 toward one end thereof and inject fluid from the fluid supply 60 through the nozzle 66 onto a workpiece. When the first piston 52 moves, air within the injection cylinder 48 is exhausted from the injection cylinder 48 to the accumulator reservoir 72 and stored, thereby increasing the pressure of the reservoir air due to the fixed volume and the increased amount of air. After the first piston 52 has finished its stroke, the solenoid 46 exhausts the injection cylinder 48 to atmosphere. The air in the accumulator reservoir 72 is returned to the injection cylinder 48, returning the first piston 52 back to its original starting position. Typically, 90 p.s.i. of compressed air is used to move the first piston 52 against 10 p.s.i. in the accumulator reservoir 72, which then is moved by compression to return the piston 52 to its original position. The control device 40 comparatively requires typically 3.66 H.P. for actuation of the injection cylinder 48 having a 1 inch bore and a 6 inch stroke to apply a one inch bead of viscous fluid. This results in a 555% increased efficiency over the conventional control 10. Thus, the main advantage of the control device 40 is that the injection cylinder 48 does not require compressed air from the main air supply 42 to return or reset the first piston 52 to its original position.

As illustrated in FIGS. 3 through 6, a mastic application fixture for applying a viscous fluid from a reservoir to a workpiece is generally shown at 80. Like parts as described above have like numerals in the fixture 80. The fixture 80 includes a support frame 82. A plurality of pneumatic viscous fluid injectors 48, 54, as described above, are connected to and spaced along the support frame 82. The top part 84 of the support frame 82 is hollow and acts as the counterbalance pressure accumulator reservoir 72 for receiving the exhausted air from the injection cylinders 48 via reset air header 74. A plurality of distribution manifolds 86 selectively distribute air to each of the injection cylinders 48. The distribution manifolds 86 are connected to one another and to the main air supply 42.

Figure 4:
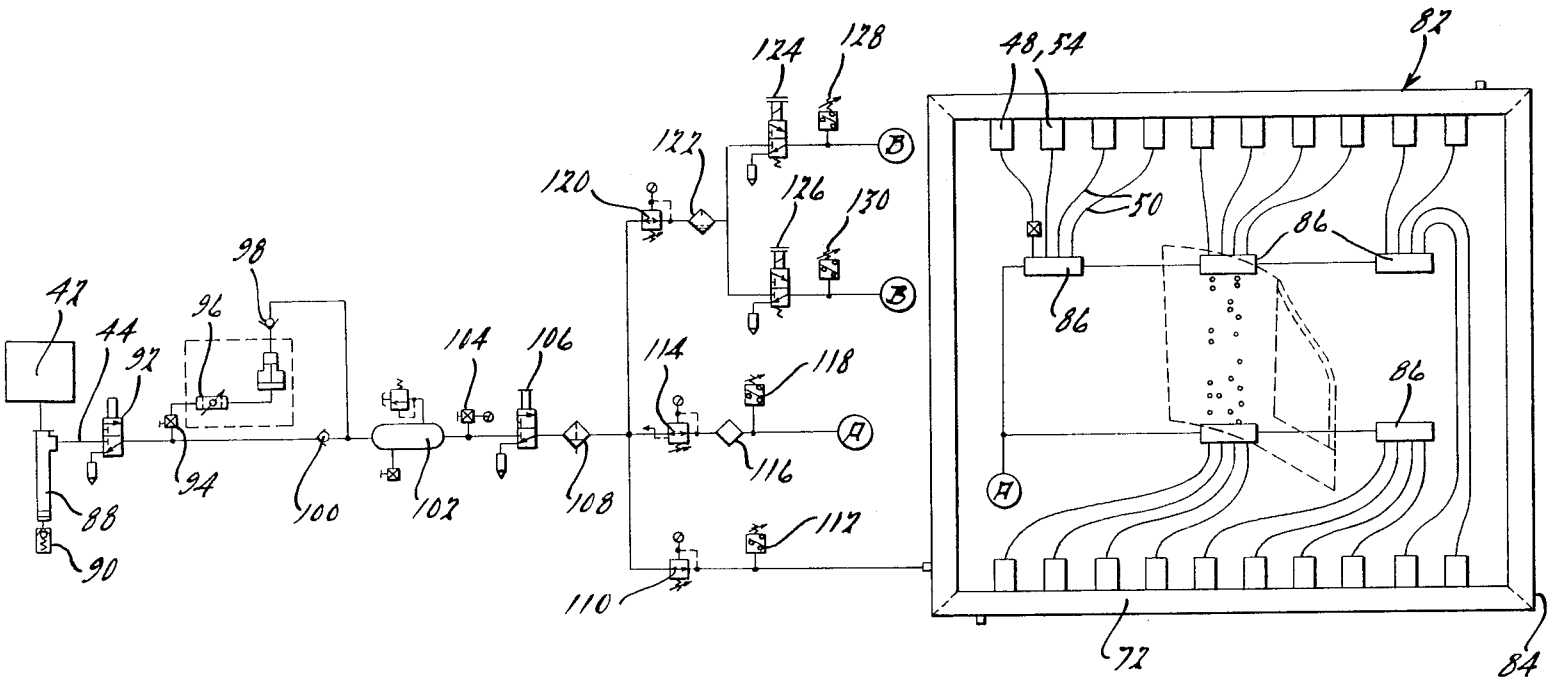
FIG. 4 is a circuit schematic for the assembly of FIG. 3.

As illustrated in FIG. 4, a drip leg 88 having a tank drain is connected to the main air supply 42. A conduit 44 is connected to the drip leg 88. A lockout valve 92 is connected to one end of the first conduit 44. A ball valve 94 and air booster 96 are connected to the lockout valve 92 via the first conduit 44. In-line check valves 98 and 100 interconnect the air booster 96 and the distribution manifolds 86. An air surge tank 102 is connected to the conduit 44. The air surge tank 102 pressurizes the air to a predetermined value. The air pressure in the air surge tank 102 may be indicated by a needle valve and pressure gage 104 connected at one end thereof. A lockout valve 106 is connected on the other side of the needle valve and pressure gage 104. An air line filter 108 is connected to the second lockout valve 106 and the first conduit 44. A first regulator 110 and pressure switch 112 interconnect the accumulator 72 and air line filter 108. A serially connected second regulator 114 and lubricator 116 and pressure switch 118 interconnect the distribution manifolds 86 and the air line filter 108. A secondary pressure or air source B pressurizes the air lines or conduits therein. A regulator 120 and lubricator 122 interconnect the air line filter 108 and the secondary air source B. A solenoid 124 and pressure switch 128 interconnect the lubricator 122 and secondary air source B, acting as a pilot pressure header to maintain a constant pressure in the lines. A secondary solenoid 126 and pressure swutch 130 interconnect another line of the lubricator 122 and secondary air source B, also acting as a pilot pressure header.

Figure 5:
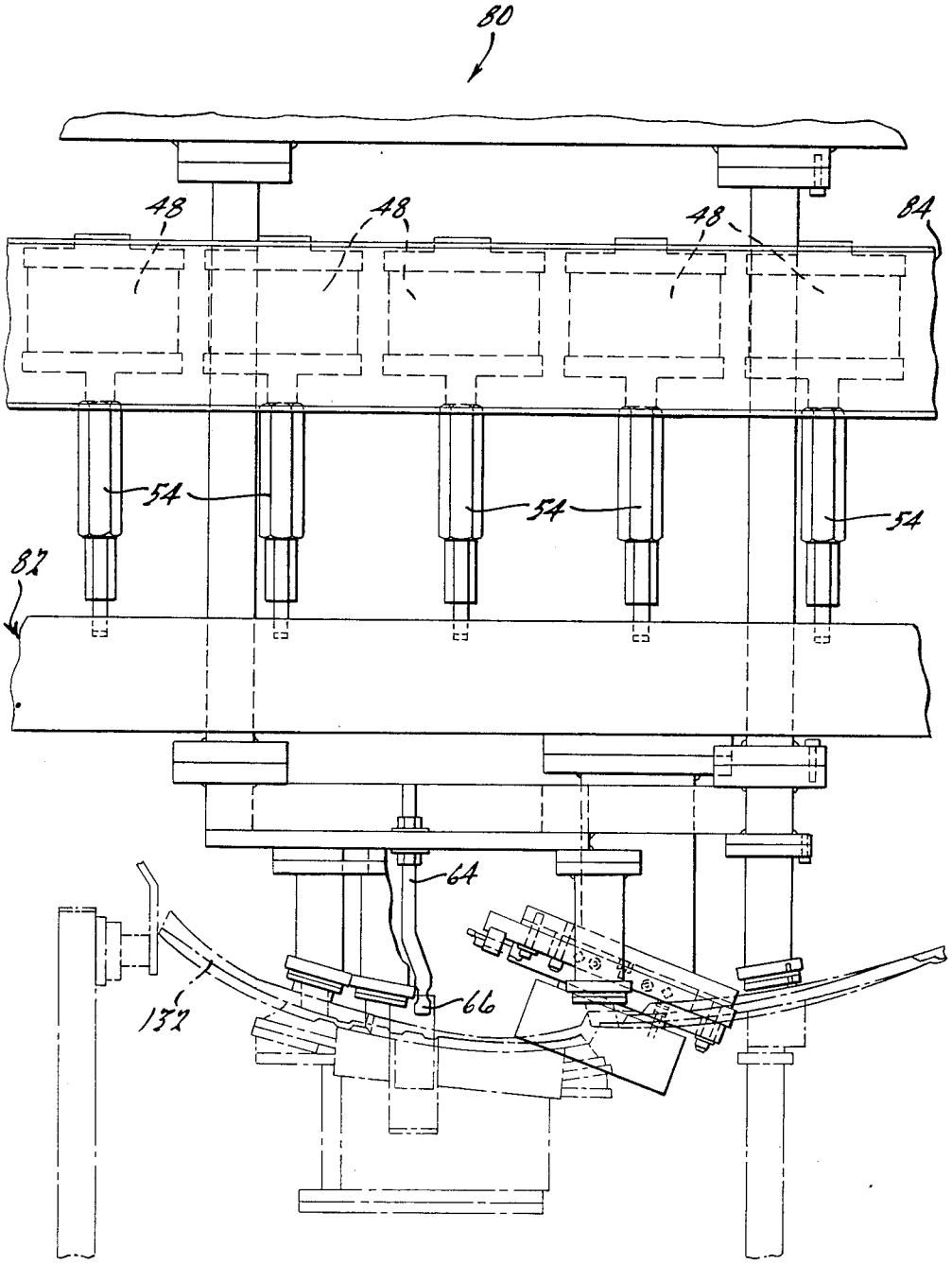
FIG. 5 is an enlarged side elevational view of a portion of the assembly of FIG. 3 acting on a workpiece.
Figure 6:
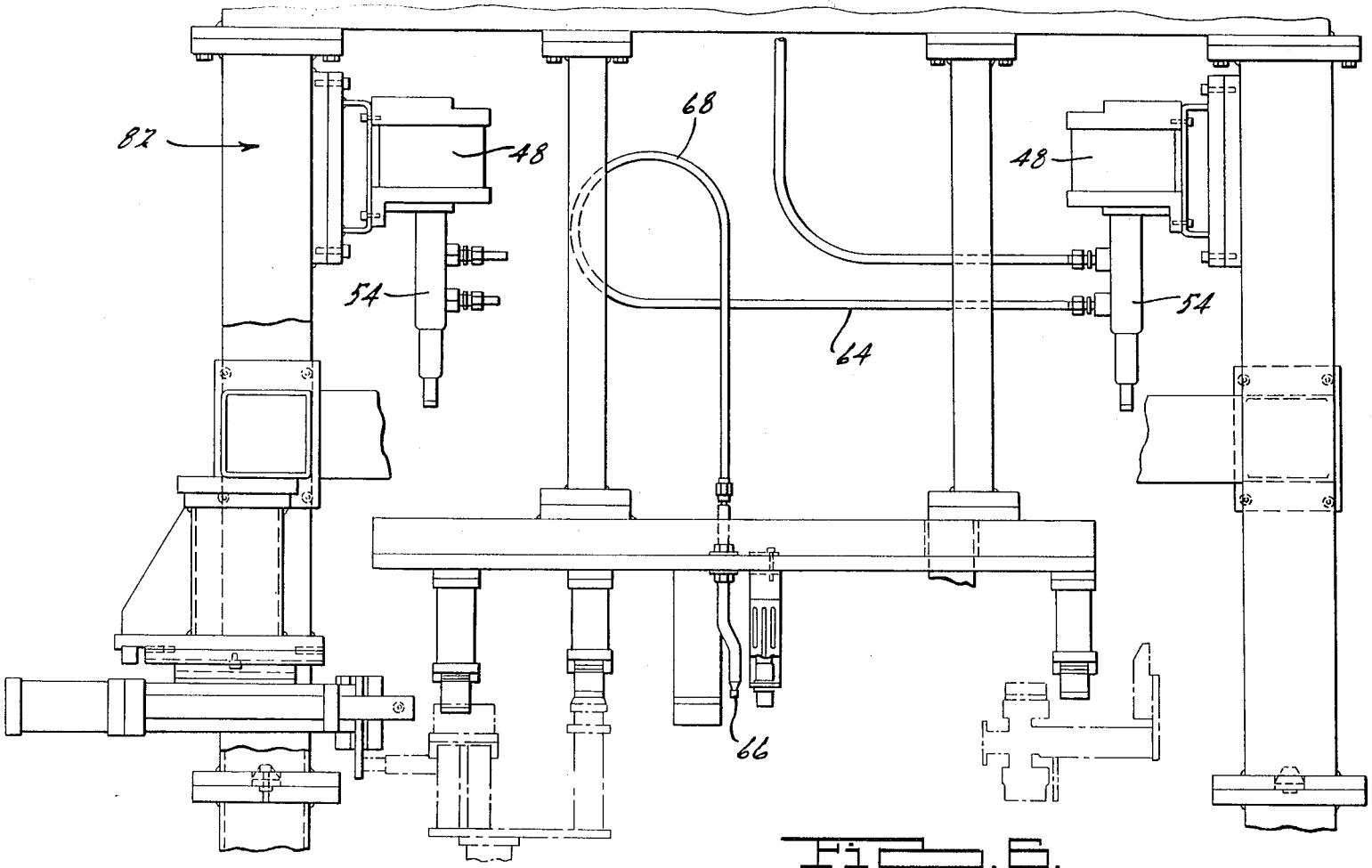
FIG. 6 is a side elevational view of the assembly of FIG. 5 with portions broken away.

Referring to FIGS. 5 and 6, the workpiece 132 is positioned below the nozzle 66 of the injection cylinder 48. A plurality of injection cylinders 48 are connected to the accumulator 84 of the support frame 82.

The subject invention has been described in an illustrative manner. It is to be understood that the terminology which has been used is intended to be in the nature of words of description rather than of limitation.

Obviously, many modifications and variations of the subject invention are possible in light of the above teachings. Therefore, the subject invention may be practiced otherwise than as specifically described.

What is claimed is:

1. An assembly for applying a fluid onto a workpiece from a fluid storage supply, said assembly comprising:

means for supplying a fluid from a fluid supply;

means for supplying compressed air from an air supply source;

injector means connected to said fluid supply means for receiving fluid from said fluid supply means and receiving air from said air supply means and injecting the fluid to the workpiece in response to air being supplied thereto;

control means interconnecting said air supply means and said injector means for controlling the air supply to said injector means to actuate said injector means; and a support frame including at least two elongated members and an accumulator means disposed within at least one of said at least two members for receiving exhausted air from said injector means in response to the actuation of said injector means and for transmitting air from said accumulator means after the actuation of said injector means is completed to allow said injector means to be actuated again.

2. An assembly as set forth in claim 1 characterized by said injector means comprising an air cylinder having a first piston slideably disposed therein, and a fluid cylinder connected to said air cylinder and having a second piston slideably disposed therein and connected to said first piston.

3. An assembly as set forth in claim 2 including a conduit connected to one end of said fluid cylinder, and a nozzle connected to the other end of said conduit.

4. An assembly as set forth in claim 3 characterized by said conduit having a loop configured therein along the length thereof to prevent siphoning of the fluid from said fluid cylinder.

5. An assembly as set forth in claim 2 characterized by said control means comprising a solenoid having a first position to allow air to flow from said air aupply means to said air cylinder and a second position to prevent air flow from said air cylinder to said air supply means.

6. An assembly as set forth in claim 5 wherein said solenoid in a second position vents said air from said air cylinder to atmosphere.

7. A mastic application fixture for applying a viscous fluid from a viscous fluid reservoir to a workpiece, said fixture comprising:

a support frame including at least one elongated support frame member;

a plurality of pneumatically driven injectors connected to and spaced along said support frame;

a plurality of distribution manifolds for selectively distributing air to each of said injectors;

an air supply means for supplying compressed air to drive said injectors;

control means interconnecting said air supply means and said distribution manifolds for controlling the air supply to said distribution manifolds;

a counterbalance pressure accumulator substantially disposed internally within said at least one elongated support frame member and connected to one side of each of said injectors for receiving exhausted air from each of said injectors in response to the actuation of said injectors and for transmitting the air from said accumulator to allow said injectors to be actuated again.

8. An assembly for applying a fluid from a fluid storage supply, said assembly comprising:

means for supplying a fluid from a fluid supply;

means for supplying compressed air from a remote air supply source;

an air cylinder having a first piston slideably disposed therein for receiving air from said air supply means;

a fluid cylinder connected to said air cylinder and having a second piston slideably disposed therein and connected to said first piston for receiving fluid from said fluid supply means and injecting the fluid to the workpiece in response to actuation of said first piston having air supplied thereto;

a solenoid having a first position to allow air to flow from said air supply means to said air cylinder and a second position to vent air from said air cylinder to atmosphere; and a support frame including at least two elongated members and an accumulator disposed within at least one of said at least two members for receiving air from said air cylinder in response to the actuation of said first piston within said air cylinder and for transmitting air from said accumulator after the actuation of said first piston to return said first piston to said first position.

9. A mastic application fixture for applying a viscous fluid from a reservoir to a workpiece, said fixture comprising:

a support frame including at least one support member;

at least one air driven injector connected to and spaced along said support frame;

at least one distribution manifold for selectively distributing air to said injector;

a means for supplying compressed air to drive said injector;

control means interconnecting said air supply means and said distribution manifold for controlling the air supply to said distribution manifold; and a counterbalance pressure accumulator disposed substantially within said at least one support frame member and connected to one side of said injector for receiving exhausted air from said injector in response to the actuation of said injector and for transmitting air from said accumulator to allow said injector to be actuated again.

10. A mastic application fixture for applying a viscous fluid from a reservoir to a workpiece, said fixture comprising:

a support frame comprised of a plurality of elongated members at least one of which members is hollow:

at least one air driven injector connected to and spaced along said support frame;

at least one distribution manifold for selectively distributing air to said injector;

a means for supplying compressed air to drive said injector;

control means interconnecting said air supply means and said distribution manifold for controlling the air supply to said distribution manifold; and counterbalance pressure accumulator means substantially disposed within said at least one hollow member and connected to one side of said injector for receiving exhausted air from said injector in response to the actuation of said injector and for transmitting air from said accumulator to allow said injector to be actuated again; and bladder means for maintaining a constant pressure of the fluid from said fluid supply means to said injector.

11. An assembly for applying a fluid from a fluid storage supply, said assembly comprising;

means for supplying a fluid from a fluid supply;

means for supplying compressed air from a remote air supply source;

an air cylinder having a first piston slideably disposed therein for receiving air from said air supply means;

a fluid cylinder connected to said air cylinder and having a second piston slideably disposed therein and connected to said first piston for receiving fluid from said fluid supply means and injecting the fluid to the workpiece in response to actuation of said first piston having air supplied thereto;

a solenoid having a first position to allow air to flow from said air supply means to said air cylinder and a second position to vent air from said air cylinder to atmosphere; and a support frame including a plurality of elongated members and accumulator means disposed substantially within at least one of said elongated members for receiving air from said air cylinder in response to the actuation of said first piston within said air cylinder and for transmitting air from said accumulator means after the actuation of said first piston to return said first piston to said first position and venting the air from said air cylinder to atmosphere upon return of said first piston.

* * * * *